US007485015B2

(12) United States Patent
Coffy

(10) Patent No.: US 7,485,015 B2
(45) Date of Patent: Feb. 3, 2009

(54) ELECTRIC APPARATUS COMPRISING AT LEAST ONE SPRING CONNECTION TERMINAL

(75) Inventor: Sylvain Coffy, Lyons (FR)

(73) Assignee: ABB France, Rueil-Malmaison (FR)

( * ) Notice: Subject to any disclaimer, the term of this patent is extended or adjusted under 35 U.S.C. 154(b) by 0 days.

(21) Appl. No.: 11/905,091

(22) Filed: Sep. 27, 2007

(65) Prior Publication Data

US 2008/0102715 A1 May 1, 2008

(30) Foreign Application Priority Data

Oct. 27, 2006 (FR) ..... 06 09463

(51) Int. Cl.
*H01R 4/48* (2006.01)

(52) U.S. Cl. ..... 439/828; 439/835

(58) Field of Classification Search ..... 439/834, 439/828, 829, 835, 838
See application file for complete search history.

(56) References Cited

U.S. PATENT DOCUMENTS

| | | | | |
|---|---|---|---|---|
| 6,875,062 | B2 * | 4/2005 | Bouley et al. | 439/834 |
| 7,234,981 | B2 * | 6/2007 | Eppe et al. | 439/834 |
| 2002/0002017 | A1 * | 1/2002 | Prost et al. | 439/834 |
| 2002/0123274 | A1 * | 9/2002 | Prost et al. | 439/834 |
| 2004/0082229 | A1 * | 4/2004 | Bouley et al. | 439/834 |

FOREIGN PATENT DOCUMENTS

| | | |
|---|---|---|
| DE | 22 05 086 | 8/1973 |
| DE | 30 30 070 C1 | 6/1982 |
| DE | 43 22 535 A1 | 1/1995 |
| DE | 10 2005 016 534 A1 | 10/2006 |
| EP | 0 434 964 A1 | 7/1991 |
| EP | 1 291 977 A2 | 3/2003 |

* cited by examiner

*Primary Examiner*—Neil Abrams
*Assistant Examiner*—Harshad C Patel
(74) *Attorney, Agent, or Firm*—Oliff & Berridge, PLC

(57) ABSTRACT

The electric apparatus comprising at least one spring connection terminal according to the invention comprises a body (4) made of insulating material having a rear face (5) comprising means (6) for attachment to the support (3), said at least one spring connection terminal comprising a connection part, connected to a conductor bar, making it possible to connect at least one conductor wire with electric components, at least one clamping spring designed to hold the end of a conductor wire in contact with the connection part, the body made of insulating material comprising at least one connection opening arranged on the front face of the electric apparatus and allowing the conductor wire to be inserted into a first housing arranged in the connection terminal. The connection part comprises a second housing designed to receive a conductor plug (23) of another electric apparatus or of an electric connection member (21), this second housing being situated opposite a side connection opening arranged in a side face of the body made of insulating material, extending transversely between the front face (7) and the rear face (5).

7 Claims, 2 Drawing Sheets

ELECTRIC APPARATUS COMPRISING AT LEAST ONE SPRING CONNECTION TERMINAL

The present invention relates to an electric apparatus comprising at least one spring connection terminal.

BACKGROUND

This type of electric apparatus comprises in a known manner a body made of insulating material having a rear face comprising means for attachment to a support, a front face opposite to the rear face. Each spring connection terminal is housed in the body made of insulating material and comprises:

- a connection part, connected to a conductor bar, making it possible to connect at least one conductor wire with electrical components,
- at least one clamping spring designed to hold the end of a conductor wire in contact with the connection part.

In addition, the body made of insulating material comprises at least one front connection opening arranged on the front face of the electric apparatus and allowing the conductor wire to be inserted into a first housing arranged in the connection terminal.

In particular, document DE 10-2005 016534 describes such a type of apparatus.

SUMMARY

When an operator desires to connect two items of electric apparatus of the aforementioned type, he usually uses an electric connection member comprising two conductor plugs designed respectively to be inserted into a connection terminal of one of the items of electric apparatus via connection openings arranged on the front faces of the items of apparatus.

Accordingly, it is no longer possible to use these terminals for connecting conductor wires to the apparatus.

In addition, since the two items of apparatus are connected with the aid of an electric connection member positioned on the front faces of the items of apparatus, the result is a considerable space requirement of the assembly.

The technical problem at the basis of the invention therefore consists in providing an electric apparatus allowing a connection of two items of electric apparatus without preventing the use of the connection terminals of the latter for the connection of conductor wires, while limiting the space requirement in height of the assembly.

Accordingly, the present invention relates to an electric apparatus designed to be attached to a support rail of the abovementioned type, wherein the connection part comprises a second housing designed to receive a conductor plug of another electric apparatus or of an electric connection member, this second housing being situated opposite a side connection opening arranged in a side face of the body made of insulating material, extending transversely between the front face and the rear face.

Therefore, since the connection part comprises a second housing situated opposite a connection opening arranged in a side face of the insulating body, it is possible to make a side connection of two items of electric apparatus by means of a suitable electric connection member comprising, on its two opposite side faces, a conductor plug having a shape matching the second housing of the connection part of each electric apparatus to be connected.

This side connection of the two items of electric apparatus makes it possible to allow free access to the connection openings arranged on the front faces of the items of electric apparatus, which therefore allows the connection terminals of each apparatus to be used for connecting conductor wires.

In addition, this side connection makes it possible to limit the space requirement in height of the assembly.

Advantageously, the connection part consists of a conductor member attached to the conductor bar.

According to another feature of the invention, the second housing is delimited on the one hand by a recess arranged in the connection part, and on the other hand by the conductor bar.

Preferably, the connection part is generally U-shaped whose base is attached to the conductor bar.

The present invention also relates to an electric assembly comprising an electric apparatus according to the invention and an electric connection member comprising, on at least one of its faces, at least one conductor plug having a shape matching the second housing of the connection part and designed to be inserted into the latter via the connection opening arranged in a side face of the body made of insulating material.

Advantageously, the electric connection member comprises a body made of insulating material comprising two substantially parallel opposite side faces, each side face of the insulating body comprising at least one conductor plug having a shape that matches the second housing of the connection part.

Preferably, each conductor plug comprises a conductor bar and an elastic strip.

In any case, the invention will be better understood with the aid of the following description, with reference to the appended schematic drawing representing, as a nonlimiting example, a preferred embodiment of the electric apparatus according to the invention.

DETAILED DESCRIPTION OF EMODIMENTS

Figure 1:
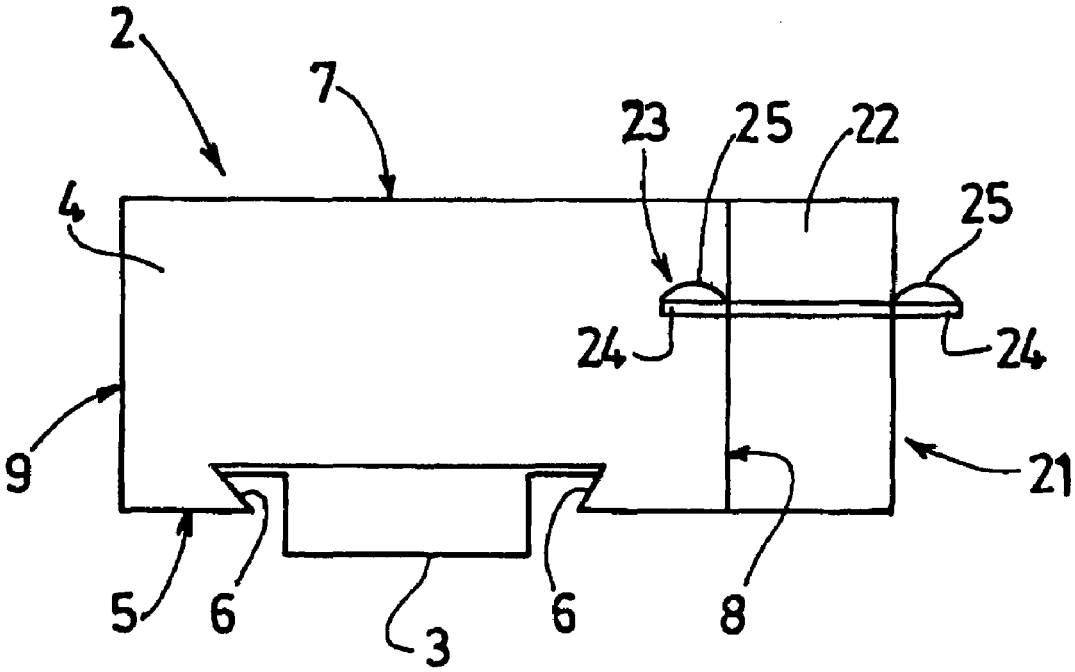
FIG. 1 is a schematic front view of a contactor attached to a support rail and connected to a connection member.

FIG. 1 represents an electric apparatus 2 designed to be attached to a support rail 3. According to the embodiment represented in the figures, the electric apparatus 2 is an electric contactor.

The electric apparatus 2 comprises a body 4 made of insulating material having a rear face 5 comprising means 6 for attachment to the support rail 3, a front face 7 opposite to the rear face, and side faces 8, 9 substantially parallel and perpendicular to the front face and the rear face.

The electric apparatus 2 comprises two spring connection terminals housed in the body 4 made of insulating material, respectively close to the side faces.

Figure 4:
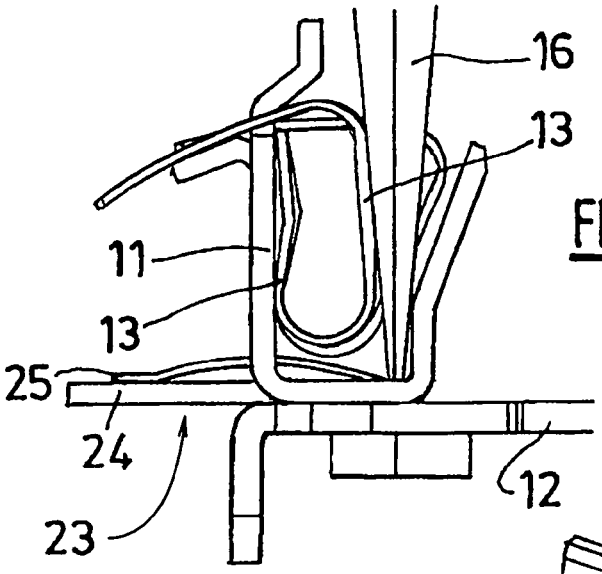
FIG. 4 is a partial side view of a connection terminal.
Figure 5:
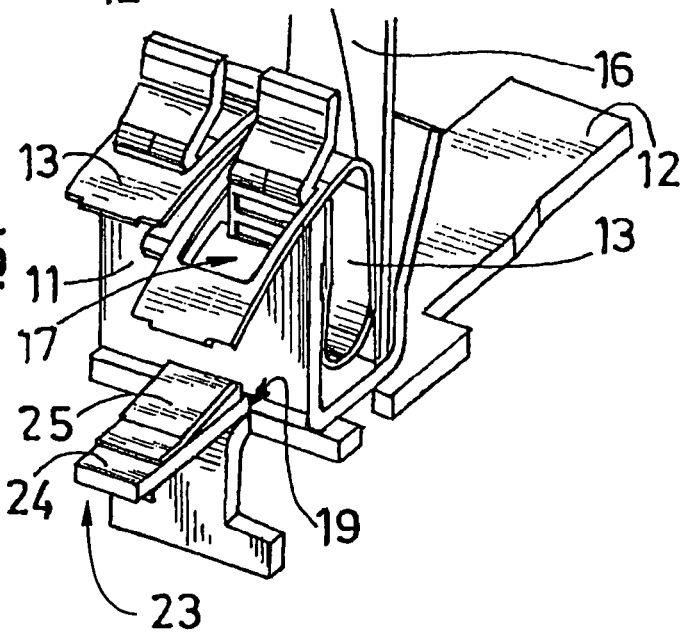
FIGS. 5 and 6 are views in perspective of the connection terminal of FIG. 4.
Figure 6:
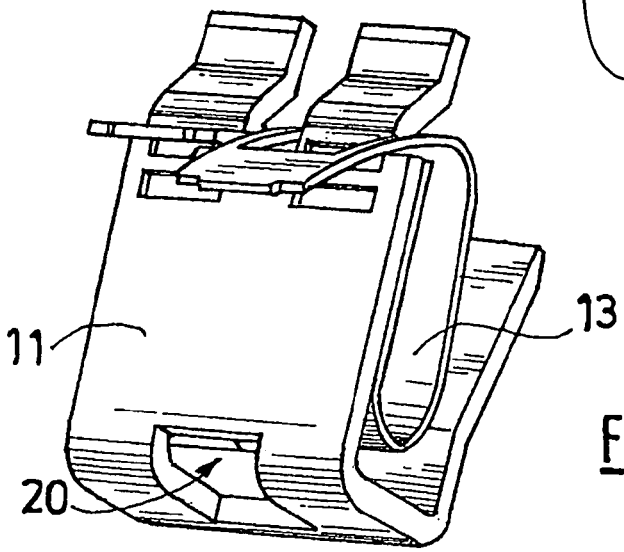

As shown in FIGS. 4 to 6, each connection terminal comprises:

- a connection part 11 consisting of a generally U-shaped conductor member whose base is welded to a conductor bar 12,
- two clamping springs 13 attached between the branches of the conductor member and each designed to hold the end of a conductor wire in contact with the connection part.

The connection part 11 therefore makes it possible to connect two conductor wires with electric components connected to the conductor bar 12.

Figure 2:
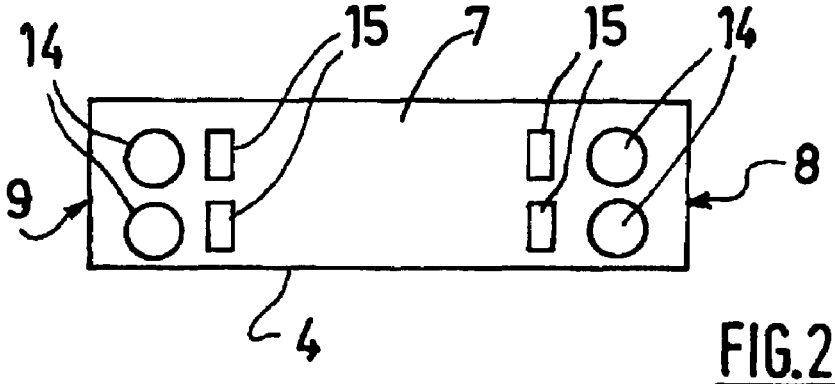
FIG. 2 is a partial top view of the contactor of FIG. 1.

As shown in FIG. 2, the body 4 made of insulating material comprises four front connection openings 14 and four actuation openings 15 arranged on the front face 7 of the electric apparatus, the connection and actuation openings being associated in pairs with a clamping spring 13.

It should be noted that each connection opening 14 allows a conductor wire to be inserted into a housing arranged in the corresponding clamping spring while each actuation opening 15 allows the tip of an actuation tool 16 to be inserted between the branches of the connection part 11 in order to actuate the corresponding clamping spring.

As shown in FIG. 5, when the tip of an actuation tool 16 is inserted into an actuation opening 15, it interacts with a wall of the corresponding clamping spring 13 so as to position a housing 17 arranged at the free end of the facing spring with the corresponding connection opening 14.

In this position of the clamping spring, it is possible to insert a conductor wire into the housing 17 of the spring. When the actuation tool 16 is taken out of the body 4 made of insulating material, the spring tends to resume its rest position and therefore compresses the conductor wire against the connection part 11.

Figure 3:
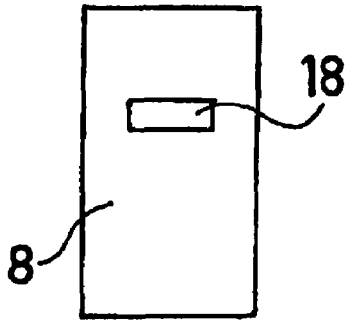
FIG. 3 is a partial side view of the contactor of FIG. 1.

As shown in FIG. 3, a side connection opening 18 is arranged in the side face 8 of the body 4 made of insulating material. This connection opening 18 is situated opposite a housing 19 of matching shape arranged in the connection part 11.

As more particularly represented in FIGS. 4 and 6, the housing 19 is delimited on the one hand by a recess 20 arranged in the connection part substantially at the base of the U, and, on the other hand, by the conductor bar 12.

This housing 19 is designed to receive a conductor plug of an electric connection member or of another electric apparatus.

FIG. 1 represents the connection of an electric connection member 21 with the electric apparatus 2.

The electric connection member 21 comprises a body 22 made of insulating material comprising two substantially parallel opposite side faces, each side face of the insulating body comprising a conductor plug 23 having a shape matching the housing 19 arranged in the connection part 11 and designed to be inserted into the latter via the connection opening 18 arranged in the side face 8 of the body 4 made of insulating material.

Each conductor plug 23 comprises a rectangular rigid conductor bar 24 and an elastic strip 25 of a shape substantially matching that of the conductor bar pressing on the latter in order to exert a return force and provide the contact between the plug and the housing.

It goes without saying that the invention is not limited solely to the embodiment of this electric apparatus described above as an example; on the contrary it covers all the variant embodiments. In this way in particular the number of connection terminals, of front and side connection openings, and of actuation openings could be different. In addition, the connection part and the conductor bar may be made in a single piece.

The invention claimed is:

1. An electric apparatus comprising at least one spring connection terminal, a body made of insulating material having a rear face comprising means for attachment to a support, a front face opposite to the rear face, the at least one spring connection terminal being housed in the body and comprising:

a connection part, connected to a conductor bar, the connection part comprising a first housing; and at least one clamping spring designed to hold the end of a conductor wire in contact with the connection part;

the body comprising at least one front connection opening arranged on the front face of the electric apparatus, the front connection opening aligned with the first housing such that a conductor wire is insertable through the front connection opening into the first housing;

wherein the connection part comprises a second housing designed to receive a conductor plug of another electric apparatus or of an electric connection member, the second housing being situated opposite a side connection opening arranged in a side face of the body, extending transversely between the front face and the rear face.

2. The electric apparatus as claimed in claim 1, wherein the connection part consists of a conductor member attached to the conductor bar.

3. The electric apparatus as claimed in claim 1, wherein a recess arranged in the connection part and the conductor bar form the second housing.

4. The electric apparatus as claimed in claim 1, wherein the connection part is generally U-shaped, the base of the connection part being attached to the conductor bar.

5. An electric assembly comprising: the electric apparatus as claimed in claim 1; and wherein the electric connection member, the electric connection member further comprises at least one conductor plug on a least one face having a shape matching the second housing of the connection part and designed to be inserted into the connection part via the side connection opening.

6. The electric assembly as claimed in claim 5, wherein the electric connection member comprises a connection member body made of insulating material comprising two substantially parallel opposite connection member side faces, each connection member side face comprising at least one connection member conductor plug having a shape that matches the second housing of the connection part.

7. The electric assembly as claimed in claim 5, wherein each of the at least one conductor plug comprises a conductor bar and an elastic strip.

* * * * *